United States Patent [19]

Kindred

[11] 4,102,535

[45] Jul. 25, 1978

[54] BOARD GAME

[75] Inventor: Michael Kindred, Nottingham, England

[73] Assignee: Invicta Plastics Limited, Leicester, England

[21] Appl. No.: 751,051

[22] Filed: Dec. 15, 1976

[30] Foreign Application Priority Data

Dec. 23, 1975 [GB] United Kingdom ..... 52689/75

[51] Int. Cl.[2] ..... A63F 3/00

[52] U.S. Cl. ..... 273/282; 273/236

[58] Field of Search ..... 273/130 R, 130 B, 135 B, 273/136 C, 135 E

[56] References Cited

U.S. PATENT DOCUMENTS

| | | | |
|---|---|---|---|
| 2,516,410 | 7/1950 | Palin | 273/130 G |
| 3,149,842 | 9/1964 | Cirrincione | 273/130 D |
| 3,568,357 | 3/1971 | Lebensfeld | 273/136 A |
| 3,603,591 | 9/1971 | Shoptaugh | 273/131 AB |
| 3,873,092 | 3/1975 | Fagan | 273/135 B |
| 3,913,921 | 10/1975 | Bourassa | 273/135 B |

*Primary Examiner*—Robert W. Michell
*Assistant Examiner*—Arthur S. Rose
*Attorney, Agent, or Firm*—Charles E. Brown

[57] ABSTRACT

A board game according to the invention comprises a board with for example, four rows of four playing areas onto which each player in turn places a playing piece until at least four are played. Each player also has a second playing piece or plate which is capable of covering all the playing areas except four, these four being visible through apertures in the plate. If a player sees that he can place the plate over the board to show three of his first playing pieces and one of his opponents, then he scores a point. If he is wrong, the attempt counts as a normal turn in the game which then continues.

3 Claims, 2 Drawing Figures

BOARD GAME

BACKGROUND OF THE INVENTION

The invention relates to a board game for two players which has been devised to exercise their perceptive skills and powers of logical thinking.

BRIEF DESCRIPTION OF THE INVENTION

The invention provides a board game for two players comprising a board marked out in a plurality of rows or lines of playing areas in an at least substantially regular pattern, a plurality of first playing pieces each of which has one of two contrasting characteristics and is adapted to be received upon a selected one of said playing areas according to a player's selection, and at least two second playing pieces in the form of plates each of dimensions sufficient to overlie the playing areas marked out on the board and provided with apertures through which first playing pieces are viewable when in position upon selected playing areas.

Preferably the total number of second playing pieces is four, each player selecting one piece for play, so that two are discarded. Each of the second playing pieces will have the same number of apertures, say four, but preferably the pattern of the apertures differs among the four pieces.

In playing, the two players will take equal numbers of the first playing pieces according to which of the two characteristics each player chooses. Each player also selects which one of the four second playing pieces he wishes to use.

The players place their first playing pieces upon the playing areas one at a time and in turn until one player forms the opinion that if he places his second playing piece upon the board, the apertures will permit an appropriate number of first playing pieces to be viewed which are divided between the two contrasting characteristics in a predetermined ratio.

For example, if there are four apertures in each of the second playing pieces, then a player will score if he can place his second playing piece upon the board to reveal three of his own first playing pieces and one of his opponent's.

If the player plays his second playing piece and finds it does not result in the desired ratio of first playing pieces being viewable, he does not score and cannot place another first playing piece until his opponent has had a further turn. Thus a "turn" is constituted either by the playing of a first or a second playing piece.

If all the first playing pieces are played, but neither player has scored, each player may continue to play his second playing piece in attempts to score. If this is unsuccessful the game may be abandoned or scored as a draw, as agreed by the players.

BRIEF DESCRIPTION OF DRAWINGS.

An example of the board game of the present invention will now be given with reference to the accompanying drawings, in which:-

DETAILED DESCRIPTION OF DRAWINGS

Figure 1:
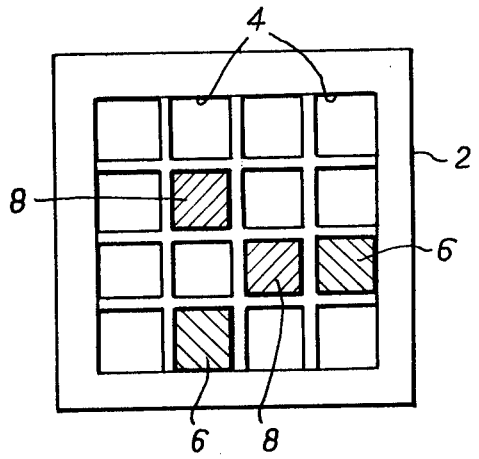
FIG. 1 shows the board with four of the first playing pieces in position.

FIG. 1 shows a board 2 having four rows each comprised of four playing areas 4, in the form of recesses adapted to receive the first playing pieces, which are in the form of red counters 6 for one player and white counters 8 for the second player.

Figure 2:
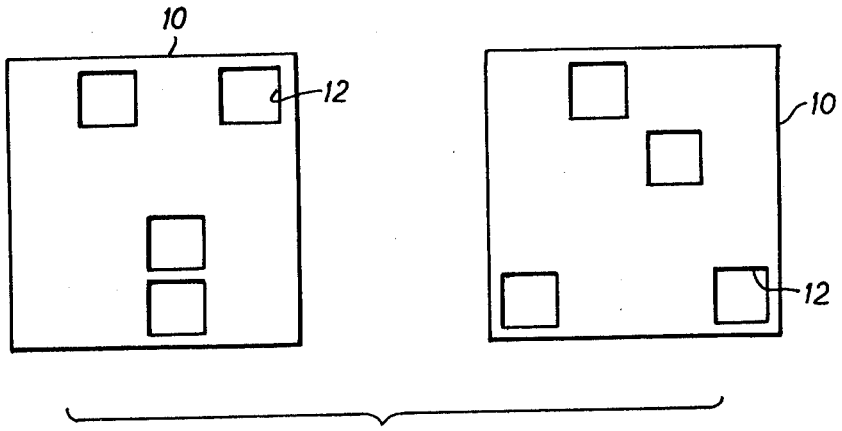
FIG. 2 shows two of the second playing pieces.

FIG. 2 shows two of four second playing pieces 10 available for the players to choose one for play. Each piece 10 has four apertures 12 but the position of these varies between the pieces, corresponding to the position of four of the playing areas.

In play, each player will select a playing piece 10 and then he places his playing pieces, 6 or 8, in turn with the other player until one player perceives that if he places his playing piece 10 over the board in a certain orientation, three of his own playing pieces, 6 or 8, and one of his opponent's, 8 or 6, are viewable. If he is correct, he scores a point and the board is cleared for the next game. If he is incorrect, his opponent may then place another of his first playing pieces or, of course, may try his own second piece 10. Thus, the placing of either a first or a second playing piece constitutes a "turn".

The winner is the player having scored most points over an agreed number of games.

Various modifications may be made within the scope of the invention as defined in the accompanying claims.

We claim:

1. A board game for two players comprising a board, said board having means defining a plurality of playing piece receiving areas arranged in a predetermined pattern, a plurality of first playing pieces divided into two sets, each piece of the first set having the same one of two contrasting characteristics, each piece of the second set having the other one of said two contrasting characteristics and each being adapted to be received upon a selected one of said board areas according to a player's selection, and separate second playing pieces for each player cooperable with said board after first playing pieces have been positioned thereon by both players to determine a game winner, said second playing pieces including at least two plates each of dimensions sufficient to overlie the board once positioned therein in any horizontal orientation, a like numbered plurality of apertures in each of said plates, said plates being distinct with the arrangement of apertures in said second playing pieces being irregular and different among said plural second playing pieces, each aperture being alignable with one of said playing piece receiving areas through which apertures respective first playing pieces are viewable when a second playing piece is correctly positioned upon player selected playing piece receiving areas.

2. A board game as claimed in claim 1 wherein the number of apertures in each of the second pieces is four.

3. A board game as claimed in claim 2 wherein there are four second playing pieces.

* * * * *